US007712998B2

(12) United States Patent
Salemie

(10) Patent No.: US 7,712,998 B2
(45) Date of Patent: May 11, 2010

(54) FLOOD WALL

(76) Inventor: Bernard Salemie, 8913 Hilton Hill Rd., Lanham, MD (US) 20706

( * ) Notice: Subject to any disclaimer, the term of this patent is extended or adjusted under 35 U.S.C. 154(b) by 151 days.

(21) Appl. No.: 11/734,822

(22) Filed: Apr. 13, 2007

(65) Prior Publication Data

US 2008/0253838 A1 Oct. 16, 2008

(51) Int. Cl.
*E02B 7/20* (2006.01)

(52) U.S. Cl. ..... 405/111; 256/13; 405/114; 405/115

(58) Field of Classification Search ..... 405/80, 405/110, 111, 114, 115; 256/13
See application file for complete search history.

(56) References Cited

U.S. PATENT DOCUMENTS

| | | | | | |
|---|---|---|---|---|---|
| 4,129,006 | A | * | 12/1978 | Payne | 405/31 |
| 5,123,780 | A | * | 6/1992 | Martinsen | 405/30 |
| 5,538,360 | A | | 7/1996 | Obermeyer | |
| 5,645,373 | A | | 7/1997 | Jenkins | |
| 5,836,714 | A | * | 11/1998 | Christensen | 404/6 |
| 5,865,564 | A | | 2/1999 | Miller et al. | |
| 5,971,661 | A | * | 10/1999 | Johnson et al. | 405/114 |
| 5,984,577 | A | | 11/1999 | Strong | |
| 6,059,491 | A | * | 5/2000 | Striefel et al. | 405/111 |
| 6,079,904 | A | * | 6/2000 | Trisl | 405/107 |
| 6,126,362 | A | | 10/2000 | Carter et al. | |
| 6,164,870 | A | | 12/2000 | Baruh | |
| 6,312,192 | B1 | | 11/2001 | Dery | |
| 6,334,736 | B1 | * | 1/2002 | Johnson et al. | 405/114 |
| 6,672,799 | B2 | | 1/2004 | Earl | |
| 6,679,654 | B1 | * | 1/2004 | Wittenberg et al. | 405/115 |
| 6,692,188 | B1 | | 2/2004 | Walker et al. | |
| 6,783,300 | B2 | | 8/2004 | Doolaege | |
| 6,840,711 | B1 | * | 1/2005 | Martinez et al. | 405/107 |
| 6,935,809 | B2 | | 8/2005 | Svensson | |
| 7,114,879 | B2 | | 10/2006 | Obermeyer | |
| 7,156,587 | B2 | * | 1/2007 | Kang | 405/302.6 |
| 7,275,888 | B1 | * | 10/2007 | Christensen et al. | 404/6 |
| 2004/0071510 | A1 | | 4/2004 | Dery | |
| 2007/0009326 | A1 | | 1/2007 | Javanbakhsh | |

FOREIGN PATENT DOCUMENTS

| | | | |
|---|---|---|---|
| JP | 10-077622 | A | 3/1998 |

* cited by examiner

*Primary Examiner*—Tara Mayo-Pinnock
(74) *Attorney, Agent, or Firm*—Lawrence E. Laubscher, Jr.

(57) ABSTRACT

A portable, inflatable flood wall is characterized by a sheet of synthetic plastic material which is folded back on itself to define a chamber between bottom, rear and front portions of the sheet and within which at least one inflatable bladder is secured. When the bladder is inflated, the rear portion of the sheet is erected to a vertical position which prevents water from passing beyond the sheet. The front portion preferably contains a plurality of openings to allow water to enter the chamber. The weight of the water on the bottom portion of the sheet serves to hold the wall in place. A plurality of such walls may be connected in end-to-end relation to construct a wall of a desired length.

9 Claims, 2 Drawing Sheets

FLOOD WALL

BACKGROUND OF THE INVENTION

Flash floods are common in low lying areas and along waterfronts when heavy rains, hurricanes or the like occur. In order to protect structures from flooding, it is common to build a wall from sandbags or the like to prevent the floodwaters from entering a building. Unfortunately, it is rather time consuming, expensive, and labor intensive to construct a flood wall from sand bags as well as to remove the wall when the flood waters subside. If not properly constructed, the wall will break and flooding will occur. Moreover, the entire process must be repeated the next time flooding is forecast.

BRIEF DESCRIPTION OF THE PRIOR ART

Inflatable barrier walls are well-known in the patented prior art as evidenced by the U.S. patents to Strong U.S. Pat. No. 5,984,577 and Obermeyer U.S. Pat. No. 5,538,360. For example, Strong discloses a flood wall having upper an lower chambers. The upper chamber is inflatable to act as a float. As water fills the lower chamber, the inflatable chamber causes the wall to rise to form a barrier. Obermeyer discloses a gate operating system including bladders which are pressurized by air to raise and lower a protective panel or barrier.

While the prior devices operate satisfactorily, they are cumbersome to handle and store, expensive, and overly complex for operation by an unskilled person. The present invention was developed in order to overcome these and other drawbacks of the prior devices by providing an inexpensive portable inflatable flood wall which may be erected quickly by a single individual in a desired location to protect a building or other structure from rising flood waters.

SUMMARY OF THE INVENTION

The portable flood wall according to the invention includes a generally rectangular sheet of flexible synthetic plastic material which is folded about spaced parallel fold lines to define bottom, rear and front portions. The front portion extends from the rear portion and is connected with an intermediate portion of the bottom portion to define a chamber. At least one bladder is arranged in the chamber and connected with the rear portion. The bladder preferably extends longitudinally generally along the width of the rear portion in parallel with the fold lines and is inflatable by a pump. A valve is connected with the bladder to retain air therein or release air therefrom. When the bladder is inflated, the rear portion of the sheet is erected to a vertical condition and the front portion tapers downwardly from the top of the rear portion to the bottom portion. The front portion contains a plurality of openings for receiving water as the water rises, with the bladder and rear portion serving to retain the water.

The weight of the water on the bottom portion of the sheet serves to retain the wall in place. Before flooding occurs, it is desirable to secure the sheet in place. Thus, a plurality of spaced openings are preferably provided in the bottom portion adjacent to the leading edge of the sheet. A plurality of stakes are driven through the openings into the ground to hold the sheet in place. In addition, a rear flap is provided extending from the junction of the bottom and rear portions which may also contain openings for receiving stakes to hold the rear of the wall in place. In lieu of stakes, sand bags may be placed on the rear flap and the leading edge of the bottom portion to hold the wall in place.

According to another feature of the invention, the flood wall includes connection devices at either end which are used to interconnect a plurality of walls in end-to-end relation to form a wall of a desired length. The connection devices comprises a plurality of spaced loops extending from the side edges of the rear portion of the sheet. The loops of adjacent walls are interleaved with a rod or other member being passed through the loops to join the sections together in a hinge-like manner. Preferably, sealing flaps extend from the rear wall edges in front of the loops to prevent water from passing between the adjacent wall sections.

BRIEF DESCRIPTION OF THE FIGURES

Other objects and advantages of the invention will become apparent from a study of the following specification when viewed in the light of the accompanying drawing, in which.

DETAILED DESCRIPTION

Figure 1:
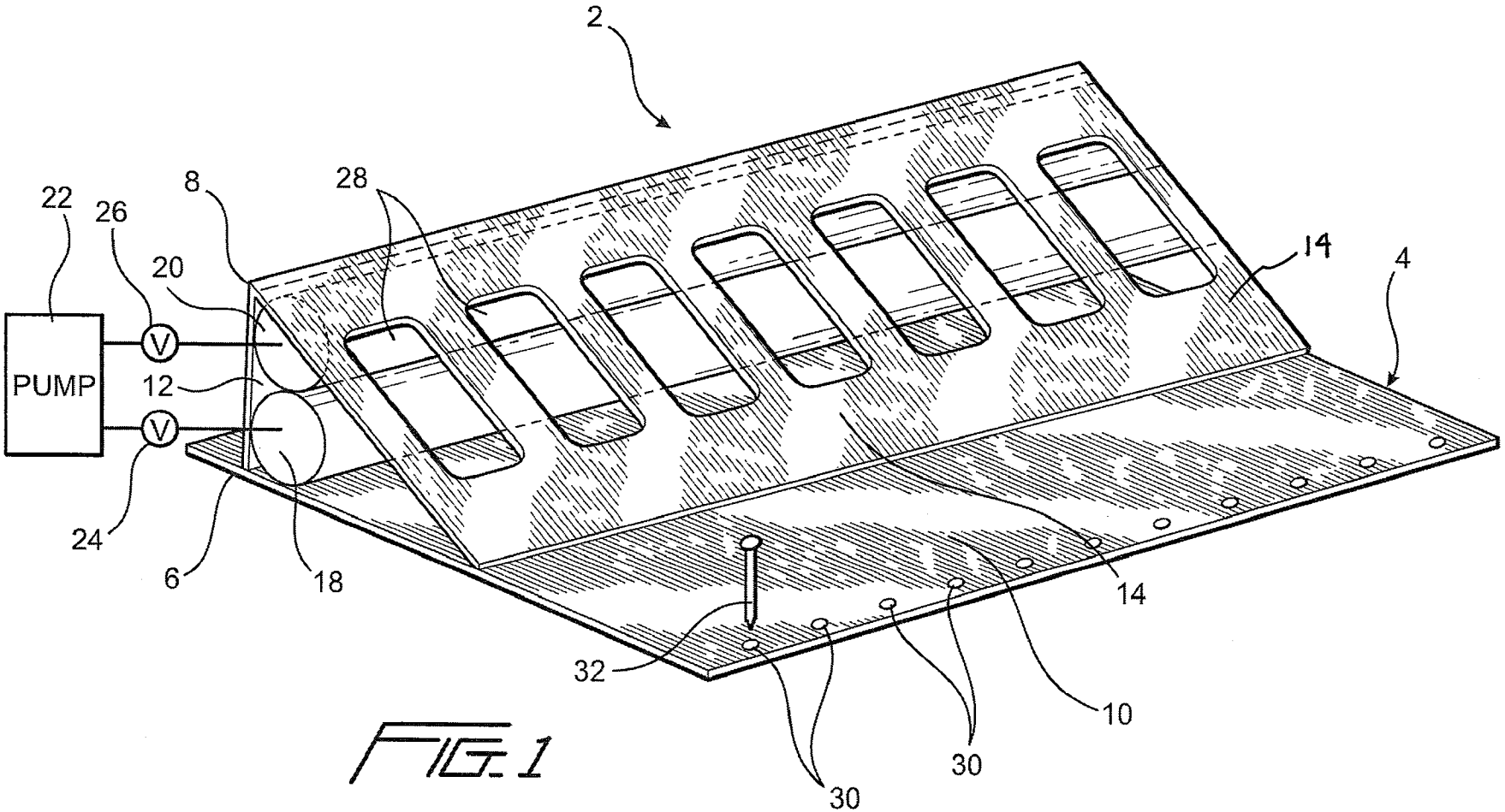
FIG. 1 is a perspective view of the flood wall of the invention in its inflated operable condition.

Referring to FIG. 1, there is shown the preferred configuration of a portable flood wall 2 according to the invention. The wall is formed from a sheet 4 of flexible material such as synthetic plastic. The preferred material has a thickness of 20 mm and is similar to that used for the mattress of a waterbed. The sheet preferably is rectangular in shape and has a pair of parallel fold lines 6 and 8 which divide the sheet into bottom 10, rear 12 and front 14 portions. The forward edge of the front portion is connected with an intermediate portion of the bottom portion such as by an adhesive, heat weld, or other known technique for joining synthetic plastic material. Once joined, the front, rear and bottom portions define a chamber 16 which is open at either end.

Within the chamber is arranged an elongated bladder 18 which extends in a direction parallel to the fold lines. Preferably, a second bladder 20 is also arranged within the chamber parallel to the first bladder. The bladders are connected with the rear wall in a stacked relation as shown in FIG. 1. The connection is also via an adhesive, heat weld or the like. The bladders 18, 20 are connected with a pump 22 via valves 22, 24, respectively. In a normal condition, the bladders are not inflated and the front and rear portions are folded against the bottom portion of the sheet. The sheet may be rolled up or folded into a compact position for storage. When it is desired to erect the wall, it is unfolded and positioned in a desired location in front of a building or other structure to be protected from advancing flood waters. The bladders are inflated by activation of the pump. As the bladders fill with air, the rear wall rises to a vertical position as shown in FIG. 1. The valves serve to control the delivery of air to and from the bladders.

The pump can be an air compressor or a manual bicycle pump, or any other device for delivering air to the bladders. It will be appreciated that the arrangement and number of bladders on the rear portion of the sheet is such that when the bladders are inflated, they abut one another and extend continuously from the bottom to the top of the rear portion. The height of the rear portion is determined by the spacing between the fold lines 6, 8 and the number and size of bladders. The wall can be constructed in different heights and widths depending on the environment in which the wall is to be used.

With the wall positioned as desired and with the bladders inflated, flood water will pass over the bottom portion 10 of the sheet 4 and rise up the front portion 14. The front portion preferably contains a plurality of openings 28 which allow water to pass into the chamber 16 and abut against the bladders 18 and 20 as well as the rear portion 12. The weight of the water serves to retain the wall in position.

Figure 2B:
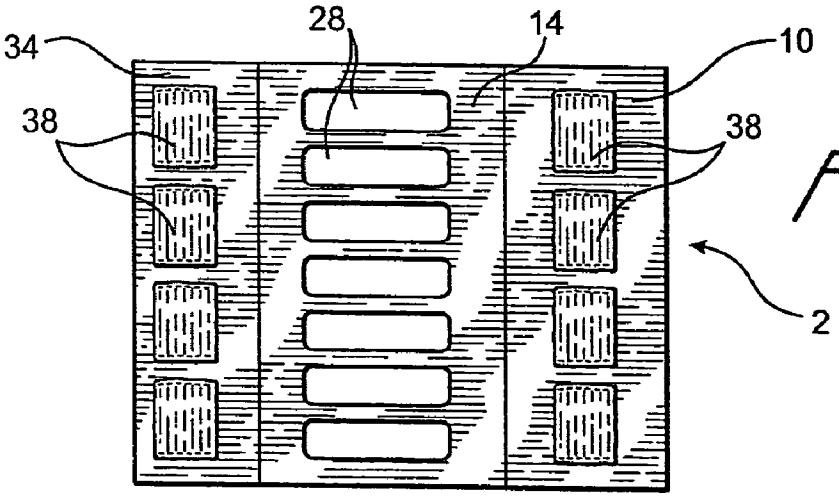
FIGS. 2A and 2B are top views of alternate embodiments, respectively, of the flood wall of FIG. 1.
Figure 2A:
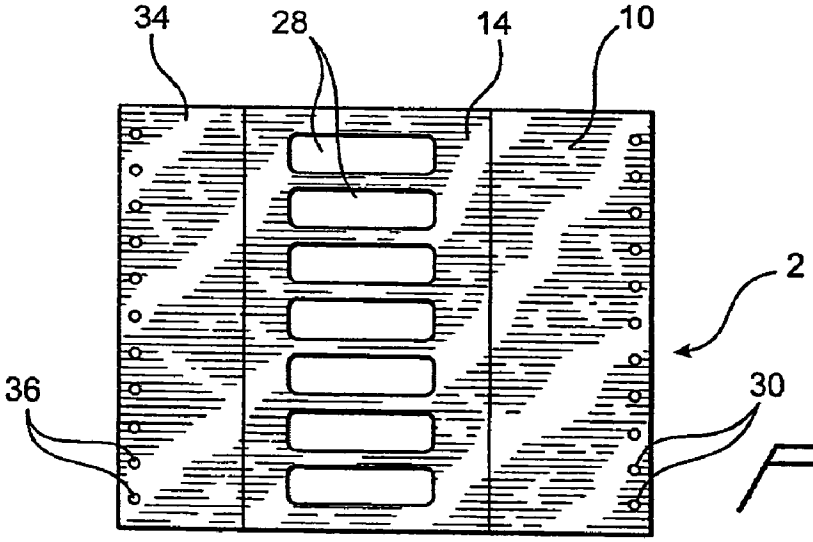

Under windy conditions, such as when a hurricane is approaching, it is desirable to retain the wall in position before the water level rises to flood stage. Accordingly, the bottom portion is provided with a plurality of spaced, parallel openings 30 which extend adjacent to the leading edge of the sheet bottom portion. A plurality of stakes 32 may be driven through the openings, respectively, into the ground surface on which the sheet has been arranged to hold the sheet in place. In addition, a rear flap 34 may be provided which extends from the fold line between the bottom and rear portions of the sheet. The flap also contains openings 36 for receiving stakes 32 to hold the rear of the wall in place. The rear flap with openings therein is also shown in the top view of FIG. 2A. An alternate arrangement for holding the wall in place before the flood waters begin to cover the wall bottom portion is shown in FIG. 2B. In lieu of the stakes and openings in the sheet, sandbags 38 may be placed on the wall bottom portion 10 and on the rear flap 34.

Figure 3:
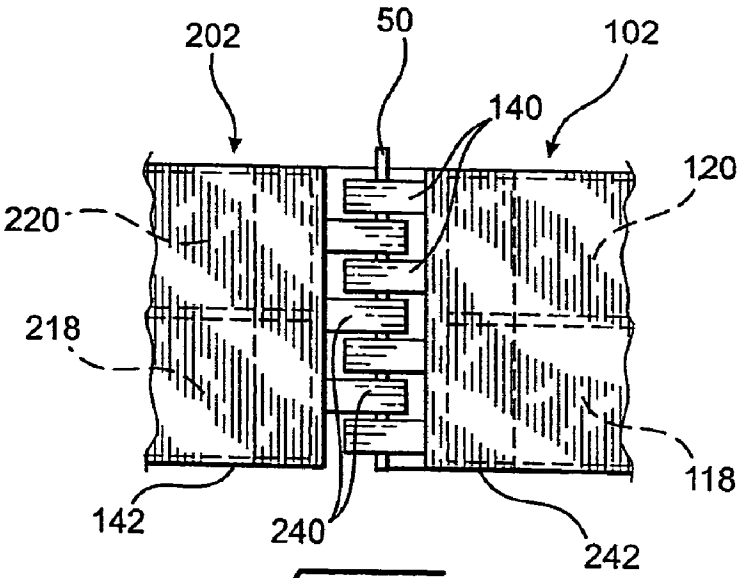
FIG. 3 is a detailed rear view of adjoining flood wall sections showing the mechanism for interconnecting the sections.

The wall shown in FIG. 1 can be made to any suitable dimension. However, if the wall is made too long, it becomes unwieldy to handle, even in its deflated condition. Thus, it is desirable to construct the wall with an inflated height of generally three feet and a length of ten feet. Where it is necessary to protect a structure wider than ten feet, a plurality of wall sections may be joined together in end-to-end fashion. In order to do so, the wall sections are provided with connection devices at either end which will be described with reference to FIG. 3. A first wall section 102 is shown connected with a second wall section 202. The section 102 has a plurality of vertically spaced loops 140 extending from a side edge of the rear portion of the wall sheet. The pair of bladders 118, 120 connected with the front surface of the rear wall portion are shown in phantom. The section 202 also has bladders 218 and 220 (shown in phantom) connected with the front surface of the rear wall portion. Extending from the side edge of the rear portion are a plurality of spaced loops 240. The loops 140 from the wall section 102 and the loops 240 from the wall section 202 are interleaved in a hinge-like fashion and a rod 50 or other member passes through the interleaved loops to join the wall sections together. The rod may be formed as a flexible fiberglass member. Alternatively, a rope or other device may be threaded through the loops to join them together in a known manner.

In order to prevent water from seeping through the area between the joined wall sections, the wall section 102 includes a sealing flap 142 which extends from the edge of the rear portion in front of the loops. If desired, the wall section 202 also includes a sealing flap 242 which extends from the edge of the rear portion in front of the loops 240 in overlapping relation with the flap 142. The pressure of the flood water holds the flaps against the loops in a generally watertight condition.

While the preferred forms and embodiments of the invention have been illustrated and described, it will be apparent to those of ordinary skill in the art that various changes and modification may be made without deviating from the inventive concepts set forth above.

What is claimed is:

1. A portable flood wall, comprising (a) a generally rectangular sheet of flexible material, said sheet having a forward edge and a rearward edge and first and second spaced fold lines parallel to said forward and rearward edges, said rearward edge being connected with said sheet at a location between said forward edge and said first fold line to define a bottom portion between said forward edge and said first fold line, a rear portion between said first and second fold lines, a front portion between said second fold line and said rearward edge, a chamber between said bottom, rear and front portions, and an extended portion of said bottom portion between said forward edge and said rearward edge; and (b) at least one bladder formed of flexible material connected with said rear portion within said chamber, said bladder extending longitudinally and parallel to said fold lines, whereby when said bladder is inflated, said rear portion is erected to a vertical condition and the chamber has a generally triangular cross-sectional configuration to define a wall section for retaining water, with the weight of the water on the bottom portion holding the wall section in place.

2. A portable flood wall as defined in claim 1, wherein said front portion contains at least one first opening between said rearward edge of said sheet and said rear portion to allow water to enter the chamber.

3. A portable flood wall as defined in claim 2, wherein a plurality of parallel bladders are connected with said rear portion to strengthen the wall section.

4. A portable flood wall as defined in claim 3, wherein said sheet further comprises a first flap extending from a rear surface of said sheet at said first fold line defining said bottom and rear portion, said first flap serving to retain the wall section in place.

5. A portable flood wall as defined in claim 4, wherein said flap contains a plurality of second openings along a rear edge thereof, and further comprising a plurality of stakes which pass through said second openings, respectively, to fasten said flap to a ground surface.

6. A portable flood wall as defined in claim 3, wherein said extended bottom portion further contains a plurality of third openings adjacent to said forward edge, and further comprising a plurality of stakes which pass through said third openings, respectively, to fasten said sheet to a ground surface.

7. A portable flood wall as defined in claim 2, wherein said sheet includes connection devices as each side edge of said rear portion, whereby a plurality of wall sections are connected together in end to end configuration to define a wall of a desired length.

8. A portable flood wall as defined in claim 7, wherein each connection device comprises a plurality of vertically spaced loops, with the loops of adjacent wall sections being interleaved in a hinge-like fashion, and a member passes through said loops to interconnect the same.

9. A portable flood wall as defined in claim 8, and further comprising a sealing flap extending from at least one side edge of said rear portion forward of said connection devices.

* * * * *